US011721933B2

(12) United States Patent
Kaszubowski et al.

(10) Patent No.: US 11,721,933 B2
(45) Date of Patent: Aug. 8, 2023

(54) SEAL HOUSING, CABLE LUG AND SYSTEM

(71) Applicant: Auto-Kabel Management GmbH, Hausen i.W. (DE)

(72) Inventors: Franz-Heinz Kaszubowski, Wassenberg (DE); Amir Hossein Attarzadeh, Mönchengladbach (DE)

(73) Assignee: Auto-Kabel Management GmbH, Hausen i.W. (DE)

( * ) Notice: Subject to any disclaimer, the term of this patent is extended or adjusted under 35 U.S.C. 154(b) by 0 days.

(21) Appl. No.: 17/923,435

(22) PCT Filed: Apr. 19, 2021

(86) PCT No.: PCT/EP2021/060067
§ 371 (c)(1),
(2) Date: Nov. 4, 2022

(87) PCT Pub. No.: WO2021/223993
PCT Pub. Date: Nov. 11, 2021

(65) Prior Publication Data

US 2023/0198196 A1 Jun. 22, 2023

(30) Foreign Application Priority Data

May 6, 2020 (DE) ..... 10 2020 002 701.6

(51) Int. Cl.
*H01R 11/22* (2006.01)
*H01R 13/52* (2006.01)
(Continued)

(52) U.S. Cl.
CPC ..... *H01R 13/5205* (2013.01); *H01R 4/34* (2013.01); *H01R 4/70* (2013.01); *H01R 11/12* (2013.01);
(Continued)

(58) Field of Classification Search
CPC .. H01R 13/5202; H01R 13/5205; H01R 4/34; H01R 4/70; H01R 11/12; H01R 2201/26
(Continued)

(56) References Cited

U.S. PATENT DOCUMENTS 3,413,593 A * 11/1968 Josephk ..... H01M 50/552 439/522
5,346,408 A 9/1994 Chupak
(Continued)

FOREIGN PATENT DOCUMENTS

DE 102017121459 A1 3/2019
EP 3288115 A1 2/2018
(Continued)

OTHER PUBLICATIONS

International Searching Authority/EP, International Search Report and Written Opinion of the International Searching Authority, Application No. PCT/EP2021/060067, dated Jul. 5, 2021, 15 pages.
(Continued)

*Primary Examiner* — Abdullah A Riyami
*Assistant Examiner* — Vladimir Imas
(74) *Attorney, Agent, or Firm* — Sunstein LLP

(57) ABSTRACT

A seal housing for a cable lug comprising a cable entry extending in a longitudinal direction, and a dome extending in a transverse direction, transversely to the longitudinal direction, wherein the cable entry extends longitudinally towards the dome and terminates in the dome, the dome comprises a receptacle for the cable lug, and the dome comprises a transversely extending through channel which extends transversely, on both sides of the receptacle into a bottom region and a cover region, characterized in that the receptacle comprises latching means for mechanically receiving the cable lug.

29 Claims, 8 Drawing Sheets

(51) Int. Cl.
*H01R 11/12* (2006.01)
*H01R 4/34* (2006.01)
*H01R 4/70* (2006.01)

(52) U.S. Cl.
CPC ..... *H01R 13/5202* (2013.01); *H01R 2201/26* (2013.01)

(58) Field of Classification Search
USPC ..... 439/266
See application file for complete search history.

(56) References Cited

U.S. PATENT DOCUMENTS

| | | | | |
|---|---|---|---|---|
| 5,413,500 | A | 5/1995 | Tanaka | |
| 7,530,843 | B1 | 5/2009 | Tesfay et al. | |
| 7,959,468 | B2 * | 6/2011 | Yong | H01R 13/65918 439/607.41 |
| 8,562,381 | B2 * | 10/2013 | Kawamura | H01R 4/34 439/801 |
| 8,790,135 | B2 * | 7/2014 | Maegawa | H01R 43/24 439/246 |
| 9,318,819 | B2 * | 4/2016 | Bäckström | H01R 11/12 |
| 9,337,567 | B2 * | 5/2016 | Rangi | H01R 13/5202 |
| 9,793,627 | B2 * | 10/2017 | Omori | H01R 4/64 |
| 10,062,974 | B2 * | 8/2018 | Okamoto | H01R 4/34 |
| 10,211,565 | B2 * | 2/2019 | Trimborn | H01R 4/34 |
| 10,439,303 | B2 * | 10/2019 | Boisnier | H01R 9/223 |
| 10,903,599 | B2 * | 1/2021 | Lienert | H02G 15/046 |
| 2018/0069339 | A1 | 3/2018 | Miyazawa | |
| 2018/0076534 | A1 | 3/2018 | Okamoto et al. | |
| 2018/0205160 | A1 | 7/2018 | Boisnier et al. | |
| 2021/0384651 | A1 * | 12/2021 | Attarzadeh | H01R 4/70 |
| 2021/0384668 | A1 * | 12/2021 | Attarzadeh | H01R 43/24 |

FOREIGN PATENT DOCUMENTS

| | | | |
|---|---|---|---|
| JP | H1186838 | A | 3/1999 |
| WO | 2018114521 | A1 | 6/2018 |
| WO | 2019052703 | A1 | 3/2019 |

OTHER PUBLICATIONS

German Patent Office, Office Action that issued on priority Application No. 10 2020 002 701.6, dated Mar. 11, 2021, 7 pages (in German).

* cited by examiner

SEAL HOUSING, CABLE LUG AND SYSTEM

CROSS-REFERENCE TO RELATED APPLICATIONS

This application is the national phase entry of international patent application No. PCT/EP2021/060067 filed Apr. 19, 2021 and claims the benefit of German patent application No. 10 2020 002 701.6 filed May 6, 2020, the disclosures of which are incorporated herein by reference in their entirety.

TECHNICAL FIELD

The subject matter relates to a seal housing for a cable lug, a cable lug for such a seal housing, and a system comprising a seal housing and a cable lug.

BACKGROUND ART

In the field of automotive engineering, electrical wiring is relevant to safety. Since vehicles are usually exposed to changing environmental conditions, such as rain, splash water, road salt, strong temperature fluctuations, and the like, electrical connections are always sources of error with regard to corrosion. In the case of battery cables in particular, which may also be permanently connected to the battery positive potential, contact corrosion can be promoted by the voltage applied to the cable.

Connections between two electrical cables are usually made using a cable lug and according screw connections. Here, it is important that the connection region is protected against penetrating moisture. Nowadays, this is usually achieved by means of a heat-shrinkable sleeve, which is placed over the connection point and then shrunk. However, such shrink tubing, especially in conjunction with silicone-sheathed cables, is problematic with regard to longitudinal water creeping between the shrink tubing and the cable insulation. A complete seal is hardly achievable here.

Various types of cable lugs are known from the prior art, with which a cable can be connected to a connecting part of an electrical system. For this purpose, the cable lug is typically connected to one end of a cable, in particular by welding, soldering or crimping in the connection region of the cable lug. Subsequently, the cable lug can be connected with its fastening region to a connecting part, for example by passing a threaded bolt of the connecting part through a contact opening and securing it with a nut or by passing a screw through the contact opening and screwing it into a threaded hole of the connecting part. In this way, a reliable and low-resistance electrical connection can be made between a cable and a connecting part of an electrical system.

In humid or otherwise corrosive ambient conditions, such as those prevailing in a motor vehicle, especially in its engine compartment, the cable lugs are usually provided with a housing to protect the connection of the cable lug to the cable and to the connecting part of the electrical system from corrosion. Furthermore, such housings are used for safety reasons to prevent accidental contact with voltaged parts.

Such a contact element with a cable lug, a conductor connected thereto and a housing is known, for example, from DE 10 2013 021 409 A1.

The housing is often formed from a plastic and can be manufactured, for example, by injection molding. Since high mechanical loads can act on the cable lug when the cable lug is connected to a contact element of an electrical system, in particular when a nut or screw is tightened, a secure embedding of the cable lug in the housing is desirable so that the cable lug cannot detach from the housing even when force is applied and permanent protection against moisture penetration is ensured.

For this reason, the subject matter was based on the object of enabling a stable, easy-to-establish connection between a cable lug and a housing, which is protected against moisture.

According to the subject matter, a seal housing for a cable lug is proposed.

SUMMARY OF THE INVENTION

The material of the seal housing is, for example, such a hard material that it enables a particularly firm anchoring of the cable lug in the housing. This may, for example, be a thermoplastic material. This can be, for example, a glass fiber reinforced plastic, e.g. PA 6 GF15.

The housing is preferably injection molded.

The housing has a cable entry extending in a longitudinal direction. A cable entry may be an opening in the housing that allows a cable to be inserted into the housing in a sealed manner. The cable entry may be formed as a channel extending in the longitudinal direction. Preferably, a cable lug, which is installed in the seal housing in the connected state, also extends in the longitudinal direction.

In addition to the channel for the cable entry, the seal housing comprises a dome. The dome also has a longitudinal extension. The direction of the longitudinal extension of the dome is referred to herein as the transverse direction. The transverse direction is preferably transverse to the longitudinal direction, in particular perpendicular to the longitudinal direction. The transverse direction can be a surface normal to an insertion plane in which a cable lug can be inserted into the cable entry. This plane lies in particular in the axis of the longitudinal direction.

To avoid misunderstandings, it should be noted at this point that the term "direction" can also mean the term "axis". An axis extends in a direction. An axis defines a straight line along a direction. The longitudinal direction may in particular pass through the center of the cable entry and extend along the longitudinal extension of the cable entry. The transverse direction may in particular pass through a center point of the through channel. The transverse direction extends in longitudinal extension of the through channel.

To avoid misunderstandings, it should be noted that the term "insertion plane" does not only mean a plane in the mathematical sense. An insertion plane can also have a height extension. This height extension is in particular equal to the material thickness of the cable lug, in particular of a fastening region of the cable lug.

The cable entry extends as a channel starting from an outer peripheral surface of the housing towards the dome and teminates in the receptacle of the dome. By means of the cable entry, it is possible to insert a cable together with a cable lug into the housing and the receptacle. In doing so, a cable lug, in particular a flat portion of a cable lug, can be inserted into the dome in the insertion plane along the cable entry.

The dome has a receptacle. In this receptacle, a contact element can be fastened with the cable lug. For this purpose, the dome has a through channel running in the transverse direction, through which the contact element can be inserted into the dome. The through channel extends on both sides of the receptacle into a bottom region on the one hand and a cover region on the other. That is, in the installed state, the cable lug lies in the insertion plane in the receptacle. On one side of the insertion plane, the through channel extends into a cover region, and on the other side of the insertion plane, the through channel extends into a bottom region.

The through channel and/or the cable entry may be formed by a tubular portion of the seal housing.

For secure fastening of the cable lug in the seal housing, it is now proposed that the receptacle has latching means for mechanically receiving the cable lug. This latching means is particularly suitable for non-destructive fastening of the cable lug in the receptacle. The latching means serve in particular for mechanical latching of the cable lug. If the cable lug is inserted into the cable entry and the receptacle in the insertion plane, mechanical latching with the cable lug is effected with the aid of the latching means. This latching is in particular a form fit.

The latching means can be formed as resilient elements which can latch resiliently behind a recess in the cable lug. The latching means can be pivotable substantially transversely to the longitudinal direction, and in particular can be elastically deformable radially outwards, so that the latching means can bend radially outwards when the cable lug is inserted, the cable lug can slide past the latching means, and the latching means can then spring back behind the recess in the cable lug. Thereby, the latching means are not destroyed during assembly of the cable lug.

With suitable auxiliary means, non-destructive unlocking is also possible in order to replace the housing and/or cable lug in the event of damage/service. For this purpose, it is proposed that the latching means have a receptacle for an expanding tool running in the transverse direction. The expanding tool can be used to exert a radially outwardly acting expanding force on the latching means. This allows the latching means to be removed from the recess on the cable lug, and the cable lug can be removed from the housing reversely to the direction of insertion. The receptacle may be formed in the shape of an arc extending radially outward. The latching means extends longitudinally in an omega shape, for example.

A free space for receiving the latching means can be arranged in the receptacle. The latching means can bend radially outwards into this receptacle, either when the cable lug is pushed in or when the latching means are spread with the spreading tool.

According to one embodiment, it is proposed that the latching means are formed for latching in a positive fit with the cable lug in the longitudinal direction. The cable lug is inserted into the cable entry in the longitudinal direction. During this insertion movement, the cable lug is preferably inserted into the receptacle in the insertion plane. During this movement, latching occurs between the cable lug and the latching means. After latching, the cable lug can no longer be pulled out of the seal housing against the direction of insertion. The cable lug is fixed in its degree of freedom in the direction opposite to the insertion direction by the latching means. To pull the cable lug out of the seal housing, the latching means must be spread radially outwards.

In order to further fix the cable lug, in particular to guide the cable lug in the insertion plane, it is proposed that the receptacle has guide rails running on both sides of the longitudinal direction. The cable lug is guided in these guide rails during insertion into the receptacle. The guide rails can also be L-shaped in cross-section and the cable lug can rest on one of the legs in the insertion direction. One leg can guide the cable lug in the transverse direction and one leg can guide the cable lug in a direction perpendicular to the transverse direction and perpendicular to the longitudinal direction. The guide rails can also be groove-shaped with a groove bottom and groove walls, with the cable lug guided in the groove.

By means of the guide rails, which are provided in particular on both sides of the receptacle, the cable lug is fixed in its degrees of freedom at least in the direction of the transverse direction during insertion.

In order to ensure that the cable lug latches with the latching means, it is also proposed that the latching means are arranged in the region of one leg of the guide rails. The guide rails are in particular characterized by two legs, a groove bottom and a groove wall, possibly two groove walls. The latching means can be on the groove bottom and/or the groove walls on at least one guide rail. It is possible that one or more latching means are provided per guide rail. Preferably, the latching means are provided on the two guide rails, in particular the groove bottoms of the guide grooves. The latching means are projections or recesses. The latching means on the guide rail extend radially in the direction of the transverse direction of the through channel. That is, the latching means extend radially to the center of the receptacle. An inserted cable lug can engage in these latching means.

According to an embodiment, it is proposed that the receptacle has an anti-twist protection which is arranged in the longitudinal direction opposite the cable entry. The anti-twist protection preferably lies in the insertion plane. The anti-twist protection is in particular a projection facing in the direction of the cable lug, which engages in an end-face recess of the cable lug, or a recess facing away from the cable lug, in which an end-face projection of the cable lug engages. The cable lug is inserted into the receptacle along the cable entry. When the cable lug is inserted into the receptacle, it engages with the anti-twist protection. The anti-twist protection serves in particular to prevent the cable lug from twisting about the transverse direction. The anti-twist protection can be formed in accordance with the latching means or can extend radially to the center of the receptacle as a projection or recess.

According to an embodiment, it is proposed that the anti-twist protection has a projection extending in the longitudinal direction in the direction of the cable entry or a recess pointing away from the cable entry. This in particular is directed in the radial direction towards the center of the receptacle. Such a projection engages in a detent groove of the cable lug in the inserted state. In the inserted state, such a recess receives a detent lug of the cable lug.

When the cable lug is inserted into the receptacle, it can no longer be pulled out of the receptacle against the direction of insertion because of the latching means. At the same time, the cable lug engages with the anti-twist protection. The cable lug can no longer be disengaged from the anti-twist protection, since it can no longer be pulled out of the housing against the direction of insertion. This prevents the cable lug from twisting in the receptacle around the transverse direction.

In order to also prevent twisting of the cable lug about the longitudinal direction, a groove for receiving an end edge of a fastening region of the cable lug in the receptacle can be provided alternatively or cumulatively to the guide rails. This groove, like the anti-twist protection, is located on the side of the receptacle opposite the cable entry. The groove preferably has a groove base and groove walls.

The anti-twist protection is preferably arranged in the groove base and/or the groove walls. The groove for receiving the end edge preferably runs in the same plane as the guide rails. When the cable lug is inserted, it is preferably pushed into the receptacle along the guide rails in the insertion plane. At the end of the insertion movement, the cable lug is furthermore inserted into the groove for receiving its end edge. The cable lug, in particular the fastening region of the cable lug, is thus held in the guide rails and/or the groove for receiving the end edge.

According to one embodiment, it is proposed that the through channel is aligned with the receptacle such that a center axis of the dome passes through a center point of a contact opening of a cable lug latched in the receptacle. A contact opening for receiving a contact element, such as a bolt, screw, pin or the like, is provided in the cable lug, in particular in the fastening region of the cable lug. After the cable lug with its fastening region has been inserted into the seal housing and has latched with the seal housing as previously described, the cable lug with its fastening region is located inside the dome.

The contact element described above can be inserted into the dome through the through channel from the cover region towards the bottom region or vice versa. To ensure that the contact element is also pushed through the cable lug, in particular the contact opening of the cable lug, when it is inserted, the latter is latched in the seal housing in the latched state in such a way that the center of the contact opening is aligned with the center axis of the dome, in particular that the center axis of the dome runs through the center of the contact opening. Then the contact element is held centrally in the through channel of the dome by the contact opening.

Subsequently, the contact element can be screwed into the through channel starting from the cover region to the cable lug, in particular to the fastening region of the cable lug. Other fastening, such as latching, clipping or the like, is also possible.

Starting from the cover region, for example, a screwing of the contact element to the cable lug can be done. For this purpose, it is necessary that the cover region is freely accessible through an opening. On the other hand, however, sealing of this opening is necessary for sealing the connection between the contact element and the cable lug. Therefore, a cover can be attached to the cover region.

In order to seal the from to the through channel, it is proposed according to an embodiment that a sealing ring extending in the transverse direction and running around the end face is arranged in the cover region. In particular, this sealing ring protrudes from the end face in the transverse direction, i.e. along the direction of extent of the through channel. The sealing ring may be formed as part of the seal housing from a hard component or from a soft component.

The cover may be formed as a screw cover. In this case, a lid wall can surround the cover region. A screw thread may be provided on the lid wall. The lid wall can extend axially beyond the screw thread in the direction of the receptacle. The cover wall can be sealed with respect to the outer peripheral surface of the cover region by a circumferential seal. In this case, a sealing ring can be arranged in a circumferential groove on the outer peripheral surface of the cover region or in a circumferential groove on the inner peripheral surface of the cover edge.

The lid can be designed as a safety lid with a resilient element, whereby the resilient element impedes rotation of the lid in the opening direction and only allows rotation of the lid in the opening direction when a contact pressure acts radially inwards. This can act as a protection against shaking/unshaking of the lid due to vibration.

The seal housing itself may be made of a harder material than a gasket material, as discussed previously. In particular, the seal housing can be formed from a hard component and sealing material from a soft component.

For particularly process-optimized production, it is proposed that the soft components are injection molded together with the hard component. In a common injection molding process, two different materials are preferably injected into a common injection mold. For particularly good recycling, it is proposed that the soft component and the hard component are manufactured separately from one another and that the soft component is arranged as a seal on the hard component during assembly.

It is also possible, and particularly preferred, to manufacture the hard component and the soft component separately from one another and to join them together in a detachable manner. This leads to an increased recycling rate, since after disassembly, the hard component can be readily separated from the soft component and the components can be made available sorted by type.

A seal can be injection-molded from a crosslinking silicone. The hard component is preferably injection molded from another plastic, for example PA with or without glass fiber content or the like.

Both the hard and the soft components can preferably be such that their materials meet the required solidity requirements over a wide temperature range, in particular between −40° C. and +180° C. This enables the cable seal to be used in automotive applications.

As explained above, both hard and soft components can be injected into a common injection molded housing. In this respect, it is proposed that the soft component is manufactured together with the hard component in a two-component injection molding process. The two-component injection molding process produces a one-piece component which is, however, formed from two different materials, in particular silicone and another plastic, in particular PBT. The transition between the hard and the soft component is already created during production and the materials form a cross-linked transition. Therein, the materials can adhere to each other by adhesion.

However, it is also particularly preferred to manufacture hard and soft components separately from each other. These are in particular covers, seal housings, gaskets, receiving region, housing receptacle, etc.

The hard component is preferably stiffer than the soft component.

For applications at high temperatures, in particular above 125° C., silicone is generally used as an insulating material for cables. A heat shrinkable sleeve does not successfully seal against silicone. To provide a successful seal, it is proposed that the soft component be formed from a silicone.

Any seal described herein may be formed from the soft component. The seal housing is formed from the hard component. Seal housing and seal materials as referred to in this application may be injected, particularly in a 2K injection molding process, from hard component and soft component, or each may be manufactured separately.

The sealing ring, which is preferably circumferential on the end face of the cover region, comes into contact with the lid when a lid is placed on the end face of the cover region. This allows the sealing ring to seal the through channel. However, it is also conceivable that the sealing ring is formed from a hard material and comes into contact with a seal made from a soft material which is arranged on the underside of the lid. Also, a sealing ring made of a soft material may be provided in the region of an annular space between the inner peripheral surface of a lid wall and an outer peripheral surface of the lid receptacle.

According to an embodiment, it is proposed that a flange extending radially outwardly is arranged in the cover region at a front edge. This flange serves to fasten the lid to the cover region, in particular to the end face of the cover region. The lid can engage behind the flange. For example, the lid may be screwed to the flange. Then the flange may be formed as an external thread. It is also possible for the flange to be engaged from behind by clips arranged on the lid. The lid can thus be fastened to the seal housing in a latching manner at the flange.

According to one embodiment, it is proposed that the lid portion is formed to receive a lid. In the fastened state, the cover is secured in a positively fit to the cover region in the transverse direction. For this purpose, the lid can be fixed in particular in its degree of freedom facing away from the seal housing in the transverse direction, in particular by an engagement from behind of the lid or the circumferential side walls of the lid on the flange or a screwing of the lid wall to the outer peripheral surface of the lid receptacle.

The lid may be connected to the seal housing in a manner that prevents it from being lost, for example by a hinge, a film hinge, a thread-like retaining element or the like.

For sealing the passage region, it is proposed that a sealing ring is arranged between an inner side of the lid rim and an outer peripheral surface of the cover region. This sealing ring may be in addition to or alternative to the seal arranged on the end face.

The cover region may be formed in the manner of a nozzle for the lid.

According to an embodiment, it is proposed that the lid engages behind the flange. This engagement from behind ensures that the lid is fixed to the cover region and, in particular, is fixed in the degree of freedom in the direction of propagation of the through channel away from the housing. A circumferential wall may be provided on the lid. This circumferential wall may be formed of sections separated from each other by interruptions. This allows the wall to yield outwardly when the cover is pressed onto the flange. The lid is fixed to the housing by elastic spring-back of the wall to engage behind the flange.

According to an embodiment, it is proposed that the cable entry is separated from the housing of the dome by a wall, the wall having an opening for the cable lug. In particular, the wall is open in the form of a slit in the insertion plane to receive the fastening region of the cable lug. By means of the wall, a separation is achieved between the area of the cable entry on the one hand and the area of the receptacle on the other hand.

According to an embodiment, it is proposed that the cable entry has a receiving region for a cable attached to the cable lug.

The cable lug is in particular metallic. The cable lug, in particular the connection region and the fastening region, are formed from an aluminum material or a copper material. It is also possible for the connection region to be made of a metal that is different from the fastening region. In particular, the cable lug may be bimetallic. For example, the connection region may be formed of an aluminum material and the fastening region may be formed of a copper material. Also, this can be the other way around.

A material may include the pure metal or an alloy with other metals.

An electrical cable, in particular a stranded cable, is attached to the connection region. The stranded cable is formed of a cable core having one or a plurality of strands and insulation surrounding the same. The strands may be of aluminum material or copper material. Preferably, the connection region is made of the same material as the strands.

The stranded wires can be soldered or welded onto the connection region with a material bond and/or crimped or screwed with a form fit or fastened in some other way. In particular, the strands may be ultrasonically welded onto the connection region.

Instead of a stranded cable, a flat cable (busbar) made of aluminum or copper can also be used. The contacting of the cable lug to the busbar can be realized as a material bond, e.g. by butt welding/ultrasonic welding, or as a positive fit, e.g. by rivets or screws.

Starting from the connection region, the cable extends away from the cable lug and in an area distanced from the cable lug the cable is formed with the insulation. The insulation preferably engages with the receiving region of the seal housing. There, the seal housing may be sealed. The receiving region receives the cable attached to the cable lug, in particular the insulation, in a sealed manner.

According to an embodiment, it is proposed that a circumferential sealing ring is arranged on the inner wall of the seal housing in the receiving region. When the cable lug is inserted into the seal housing, it can be pushed through the sealing ring into the receiving region. In the inserted position, the sealing ring lies closely against the insulator of the cable. Furthermore, the sealing ring lies against the inner wall of the seal housing. The sealing ring is elastically compressed between the insulator of the cable and the inner wall of the housing, in particular the inner wall of the receiving region.

According to an embodiment, it is proposed that the sealing ring has ribs which are longitudinally spaced apart and face radially outwardly . Radially outward in this context is meant radially to the cable lug and/or to the cable attached to the cable lug. With these radially outwardly pointing ribs, the sealing ring can be attached to the inner wall of the seal housing. A correspondingly complementary structure for the ribs can be provided on the inner wall of the seal housing, so that the ribs can engage in grooves on the inner wall of the seal housing which are complementary thereto. When reference is made in this context to the inner wall of the seal housing, this always also refers to the inner wall of the receiving region.

The interlocking of the ribs on the one hand and the circumferential grooves on the inner wall of the seal housing on the other hand results in a particularly good sealing effect.

According to one embodiment, it is proposed that the sealing ring has longitudinally spaced, radially inwardly facing ribs. These radially inwardly pointing ribs rest against the insulation of the cable. In the inserted position, the cable presses the adjacent ribs radially outwards and compresses them. This creates a contact pressure of the ribs onto the insulation, which improves the sealing effect.

According to an embodiment, it is proposed that the sealing ring has a longitudinally extending sealing lip on its end face facing away from the dome. The sealing ring preferably has a longitudinal extension which runs in the longitudinal direction. On the side opposite the dome in the longitudinal direction, the sealing ring may have a sealing lip extending axially on its end face. The sealing lip may engage with an end cap to provide a good sealing effect.

According to an embodiment, it is proposed that an end cap (grommet) is arranged on the receiving region. In particular, the end cap is slipped over the cable with a receptacle before the cable is inserted into the seal housing. The end cap can then be pressed against the seal housing in the area of the cable entry, in particular against the end face in the area of the cable entry. In this context, it is proposed that the end cap engages around the receiving region at an outer peripheral surface.

According to an embodiment, it is proposed that the end cap has a receptacle for a cable. From the side of the cable facing away from the cable lug, the end cap with the receptacle can be pushed onto the cable, or the end cap with its receptacle can be pushed onto the cable before the cable lug is fastened to the cable. After the cable lug has been pushed into the seal housing in the direction of insertion, the insulation of the cable is preferably located inside the cable entry and is preferably sealed against longitudinal water by the sealing ring. The end cap can then be pushed onto the housing and fastened thereto. Preferably, radially penetrating water is sealed by the sealing lip that lies against the end cap.

In order to optimize this seal, it is proposed that the end cap has groove webs facing longitudinally in the direction of the dome within the cable entry in the assembled state. These groove webs span a groove with a groove base and groove walls. In the fastened state, the sealing lip is received within the groove and preferably pressed elastically against the groove base. Radial water penetration is sealed by the sealing lip.

It may also be provided that the end cap is formed as a grommet. As such, the grommet can embrace the outer peripheral surface of the receiving region. Radially outwardly pointing, preferably circumferential projections can be provided on the outer peripheral surface of the receiving region. The inner wall of the grommet may have corresponding recesses thereto, so that the projections and recesses engage one another and thus a seal is achieved. The grommet may engage behind a projection in the direction of the dome.

To fasten the end cap to the seal housing, it is proposed that the end cap engages with latching means on an outer peripheral surface of the receiving region. In particular, this may be accomplished by engaging behind detent lug. In particular, the latching means may be a clip fastener.

Furthermore, apart from sealing the cover region and the cable entry, the bottom region must also be sealed so that the connection between the contact element and the cable lug is protected against moisture. For this reason, it is proposed that the bottom region is formed to receive a housing receptacle. This housing receptacle serves to seal the through channel in the bottom region.

According to an embodiment, it is proposed that the housing receptacle is part of a housing dome of an electrical add-on part. For example, it is conceivable that a contact element protrudes from a surface on an electrical component, in particular protrudes vertically. Such a contact element may be provided with a thread at its end face. The contact element may be formed to be connected to the cable lug. Now it is possible to put the seal housing with the through channel over the contact element so that the latter comes into engagement with the cable lug in the dome. To seal the bottom region, a housing element can also protrude in the direction of the contact element on the add-on part from which the contact element protrudes. This can be a housing dome, which is formed in the form of a housing receptacle for the bottom region. Thus, with the aid of the seal housing according to the subject matter, a connection of a cable with a contact element of an electrical system or an electrical add-on part can be realized in a particularly simple manner. A housing dome with a contact element is provided on the add-on part, the housing dome circumferentially enclosing the contact element and the housing dome being formed for engagement with the bottom region of the seal housing. It is also possible that the housing dome is independent of a housing of an add-on part.

According to an embodiment, it is proposed that the housing receptacle comprises a through channel for receiving a contact element.

According to an embodiment, it is proposed that a seal is arranged between the contact element and the inner wall of the through channel of the housing receptacle. This seal can also be circumferential and elastically compressed between the contact element and the inner wall of the through channel. With the aid of this seal, the ingress of longitudinal water is prevented.

The through channel of the housing receptacle extends into the dome in the transverse direction. Thus, an annular space is formed in the transverse direction between the outer wall of the through channel of the housing receptacle and the inner wall of the dome, in which the seal can lie.

According to an embodiment, it is proposed that a seal is arranged at an end face of the bottom region. In particular, this seal is such that it embraces the end edges of the bottom region on both sides, i.e. on the inside and on the outside. The housing receptacle can lie against the inner side of the seal with its through channel and lie against the outer side of the seal with outer, circumferential walls.

For this reason, it is proposed that the seal is arranged at the end face of the bottom region between the seal housing and the housing receptacle.

According to an embodiment, it is proposed that the seal has transversely spaced, radially inwardly facing ribs on the end face of the bottom region. Here, radially is to be understood in relation to the contact element. These inwardly facing ribs may lie against the contact element. It is also possible for the inwardly facing ribs to lie against complementary circumferential grooves on the outer peripheral surface of the through channel of the housing receptacle. This provides a particularly good seal against longitudinal water.

In another aspect, a cable lug is provided for a seal housing described herein.

As already explained above, this cable lug is formed from a connection region and a fastening region. An electrical cable, in particular one or more strands of an electrical cable, may be electrically contacted in the connection region. For this purpose, for example, a crimp connection, screw connection, solder connection, welding connection or the like can be provided. In particular, welding of the strands of the cable on the surface of the connection region is preferred.

The connection region, in particular at least partially, the fastening region, in particular completely, is formed as a flat part. In the inserted state, the cable lug with the fastening region is inserted into a receptacle of the seal housing and latched there. For this purpose, the fastening region, which is formed as a flat part, has at least one latching means on at least one of its outer edges, which comes into mechanical contact with latching means of the seal housing. When the latching means of the seal housing and the cable lug latch, the cable lug is fixed at least in the degree of freedom in the direction of the connection region of the cable lug. This direction is in particular the longitudinal direction of the cable entry, pointing out of the seal housing.

The latching means may be formed by recesses and projections complementary to one another. Thus, it is possible for a projection to be formed in the seal housing and a recess to be formed on the flat part, or vice versa. Where reference is made in this application to recess or projection in connection with the latching means, the other may be meant respectively.

The flat part or the cable lug is pushed into the seal housing with the fastening region, which is formed as a flat part, with its end face first. If the latching means is a recess, then this has a steeper flank in the direction of an end face of the flat part than in the direction of the fastening region. If the detent is a projection, it has a flank that is flatter in the direction of an end face of the flat part than in the direction of the fastening region. During insertion, the latching means of the seal housing and the cable lug slide past one another and engage behind one another when the cable lug latches in its end position.

According to an embodiment, it is proposed that the fastening region has a latching means as a groove or lug extending longitudinally from the end face of the flat part. When the detent groove is described below, the mechanical reversal is of course always also meant. Either a latching lug of the seal housing engages in a detent groove of the fastening region or a latching lug of the fastening region engages in a detent groove in the seal housing. Latching in the area of the end face prevents twisting of the cable lug in the seal housing about the transverse direction.

The fastening region is formed as a flat part and has a contact opening for a contact element. The contact element can be inserted through the through channel into the contact opening.

According to an embodiment, it is proposed that the fastening region is guided in the longitudinally extending guide rails of the receptacle. In particular, the material thickness of the fastening region corresponds to the distance between the groove walls of the guide rails, so that the cable lug can be inserted into the grooves in a clearance fit.

In another aspect, there is provided a system comprising a previously described seal housing and a previously described cable lug.

BRIEF DESCRIPTION OF THE DRAWINGS

In the following, the subject matter is explained in more detail with reference to drawings showing embodiments. The drawings show.

DETAILED DESCRIPTION OF SPECIFIC EMBODIMENTS

Figure 1A:
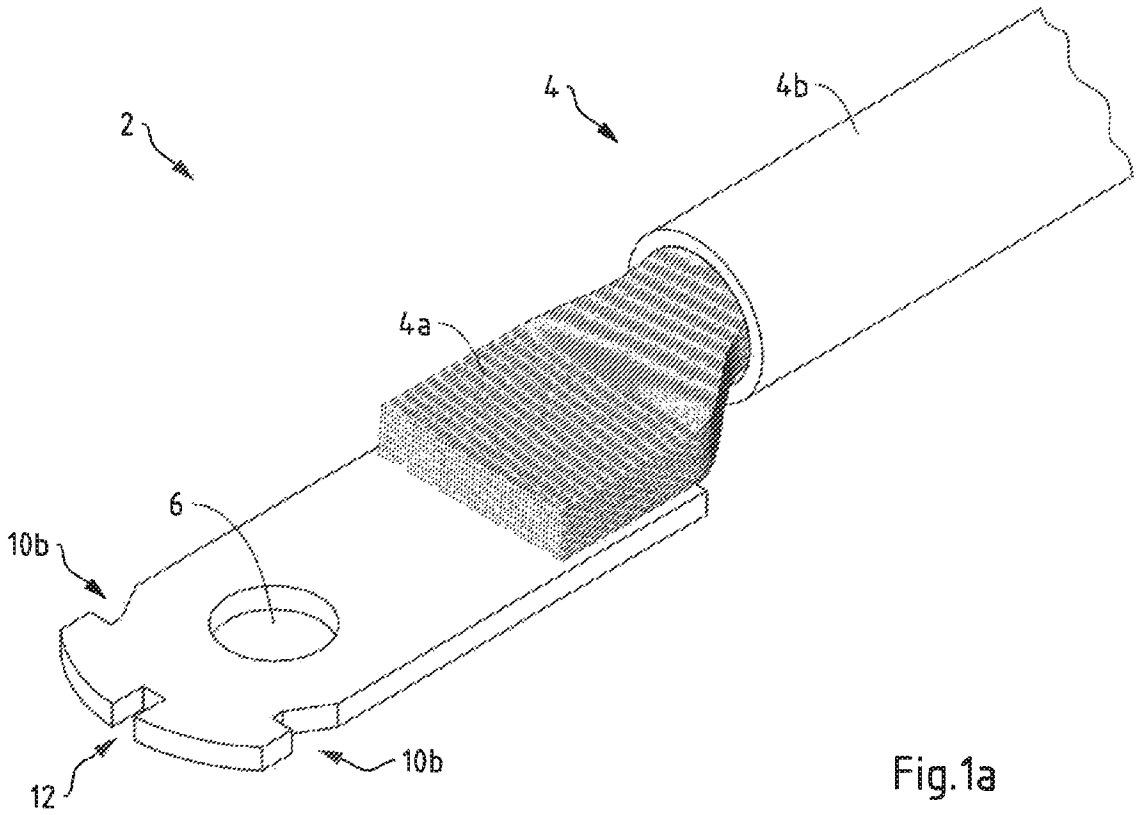
FIG. 1*a* a top view of a cable lug according to an embodiment.

FIG. 1*a* shows a cable lug 2 with a cable 4 attached thereto. The cable lug 2 has a connection region 2*a* and an fastening region 2*b*. As shown, the connection region 2*a* may be formed as a flat part to which the cable can be soldered or welded. However, it is also possible for the connection region 2*a* to have a screw-on surface, a crimp connection or the like.

In the connection region 2*a*, a stranded wire 4*a* of the cable is fastened, in particular fastened with a material bond. The stranded wire 4*a* of the cable is surrounded by an insulator 4*b*.

The material of the stranded wire 4*a*, which may be formed as a single strand or as a multi-strand, may be an aluminum material or a copper material. Accordingly, at least the surface of the connection region 2*a*, whether by the material of the cable lug 2 itself or by a coating, may be formed of the same or a similar material.

The cable lug 2 may be formed of a first material, for example aluminum material or copper material and may be coated with nickel material and/or tin material and/or further materials over the entire surface or, in particular, only in the region of the connection region 2*a* or only in the region of the fastening region. It is also possible for the cable lug 2 to be bimetallic, with the connection region 2*a* being formed from a copper material and the fastening region 2*b* being formed from an aluminum material. The combination of materials may also be the other way around.

The cable lug 2 extends longitudinally from the connection region 2*a* into the fastening region 2*b*. The fastening region 2*b* is formed in particular as a flat part A contact opening 6 for receiving a contact element, as will be described below, is formed in the fastening region 2*b*. The contact opening 6 can be drilled, milled, punched, cut or the like. In particular, the contact opening 6 is centered on the fastening region 2*b*.

The fastening region 2*b* is delimited by a circumferential outer edge 8. The outer edge 8 extends laterally of the contact opening 6 and transitions into a front edge 8'.

At the lateral outer edges 8, the fastening region 2*b* has a recess 10*b* formed as a recess. In the example shown, the recess 10*b* is on both sides of the contact opening 6.

It can be seen that the recess 10*b*, starting from the front edge 8', is offset inwardly with a steep flank and extends in the direction of the connection region 2*a* with a flatter flank towards the outer edge 8.

The steep edge facing the front edge 8' allows the cable lug 2 to be latched in a seal housing, as will be described below.

At the front edge 8', the cable lug 2 has a further twist protection 12 formed as a recess. A detent lug can engage in this, as will be described below.

Figure 1B:
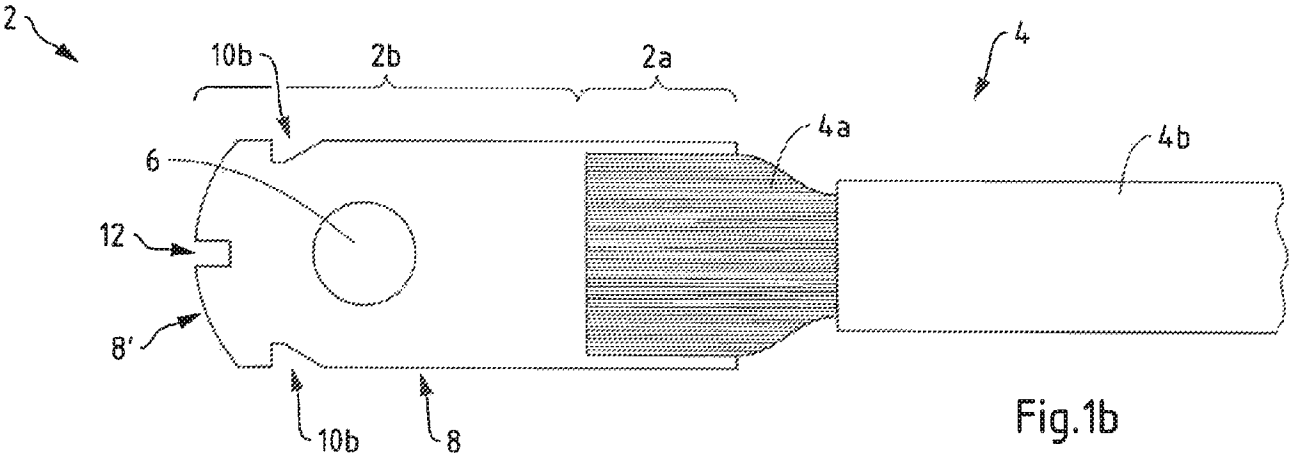
FIG. 1*b* a view of a cable lug according to FIG. 1*a;*

FIG. 1*b* shows the cable lug 2 in a view. It can be seen that the contact opening 6 is a hole. The strands 4*a* of the cable 4 are welded onto the connection region 2*a*, in particular by means of friction welding, e.g. ultrasonic welding, in which the strands 4*a* are compacted to the cable lug 2 during welding.

Figure 1C:
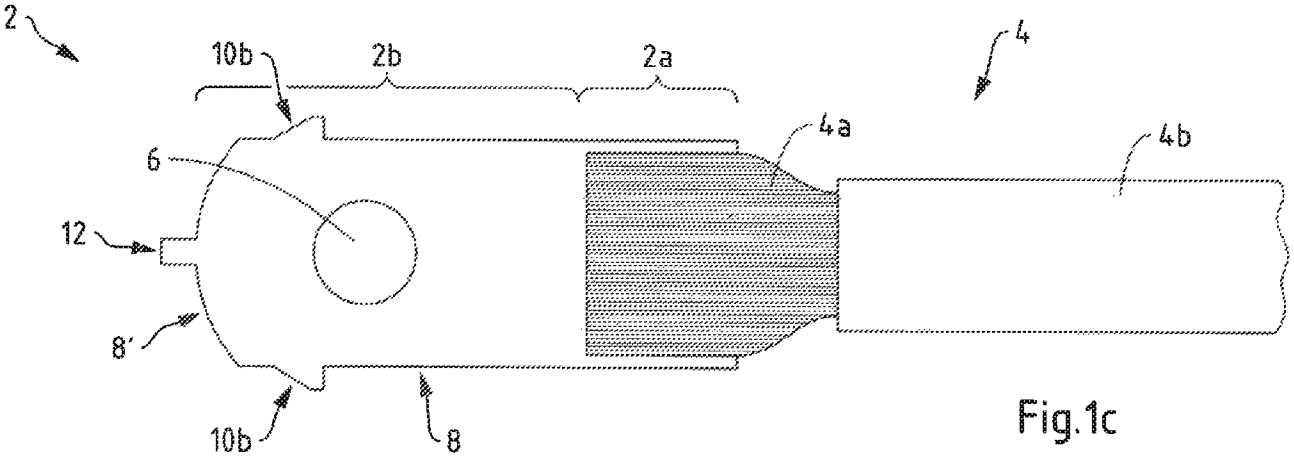
FIG. 1*c* a top view of a cable lug according to an embodiment.

FIG. 1*c* shows an embodiment of a cable lug 2 corresponding to FIG. 1*a*, whereby, in contrast to FIG. 1*a*, a projection 10*b* is provided and the anti-twist protection 12 is also formed as a projection. These can interact with corresponding recesses in the seal housing. It can be seen that on the protrusions 10*b*, starting from the front edge 8', first a flat flank extends outward and then a steep flank extends toward the outer edge 8'. The flat flank allows the cable lug 2 to slide into the receptacle of the seal housing. The steep flank allows the cable lug 2 to latch into a recess of the seal housing.

Figure 2:
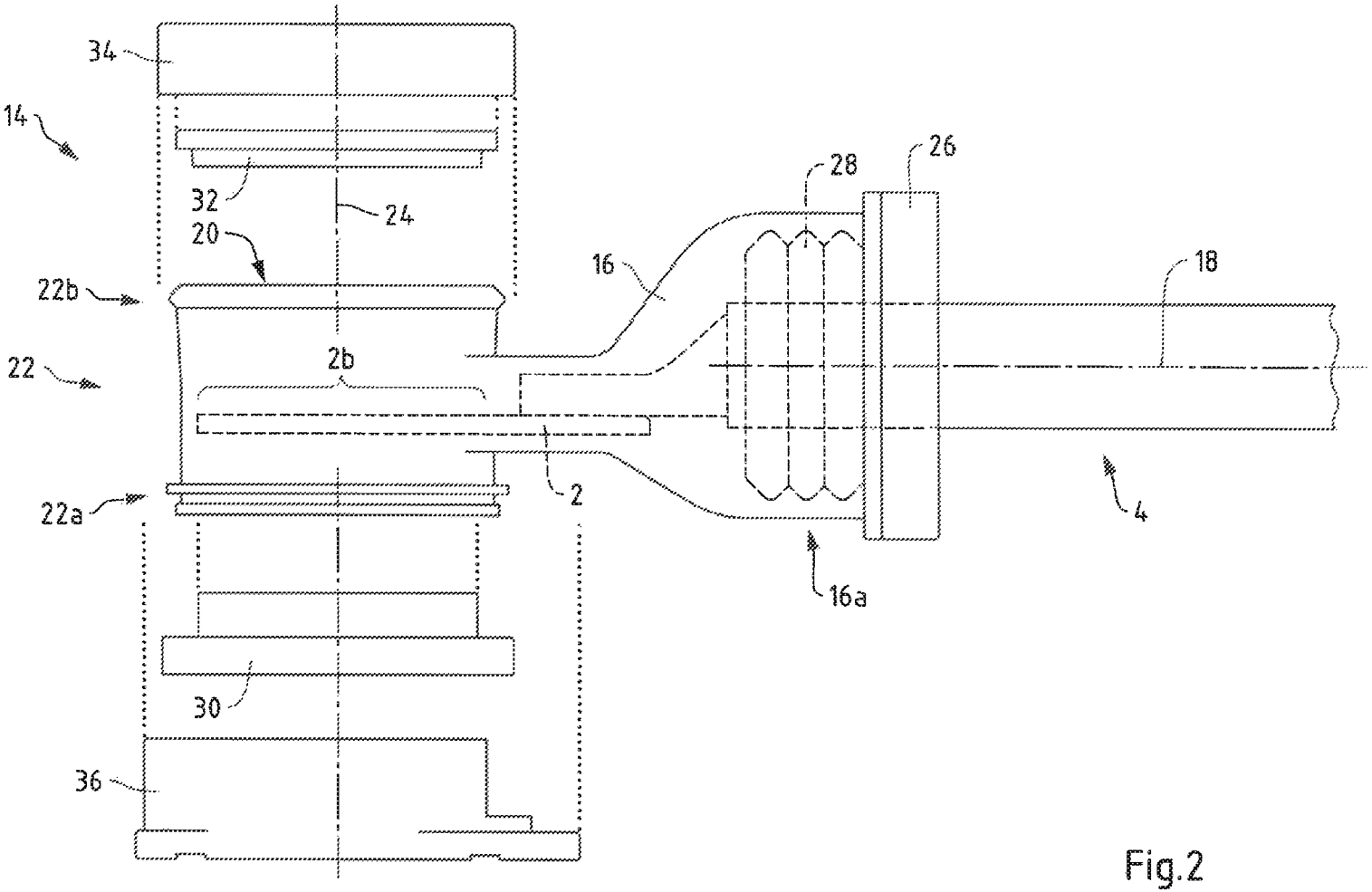
FIG. 2 a schematic view of a seal housing with a cable lug according to an embodiment.

FIG. 2 shows the cable lug 2 installed in a seal housing 14. It can be seen that the seal housing 14 has a cable entry 16 extending in a longitudinal direction 18. The longitudinal direction 18 can also be understood as a longitudinal axis and runs in particular coaxially with the longitudinal axis of the cable 4. Transverse to the longitudinal direction 18, a through channel 20 of a dome 22 runs in a transverse direction 24. The transverse direction 24 can also be understood as a vertical axis or transverse axis. The dome 22 has a bottom region 22*a* and a cover region 22*b*.

It can be seen that the cable 4 is inserted into the cable entry 16 through an end cap 26. The end cap 26 is attached to a receiving portion 16*a* of the cable entry 16.

A seal 28 is disposed on the inner peripheral surface of the receiving portion 16*a* and the outer peripheral surface of the insulator 4*b*.

Starting from the cable entry 16, the cable lug 2 is inserted into the cable entry 16 and the dome 22 along the longitudinal direction 18, which is the insertion direction. As will be described in more detail below, the cable lug 2 engages with its fastening region 2*b* within the receptacle of the dome 22.

As will be described in more detail below, the bottom region 22*a* is sealed by a sealing ring 30. Similarly, as will be described in further detail below, the cover region 22*b* is sealed by a sealing ring 32.

The seal 28 and the sealing rings 30, 32, may be made of soft components and provided as separate components from the seal housing 14. As a result, the seals 28, 30, 32 can be removed from the seal housing 14 and the latter can be recycled, if necessary, in accordance with the material, when it is replaced.

Figure 3:
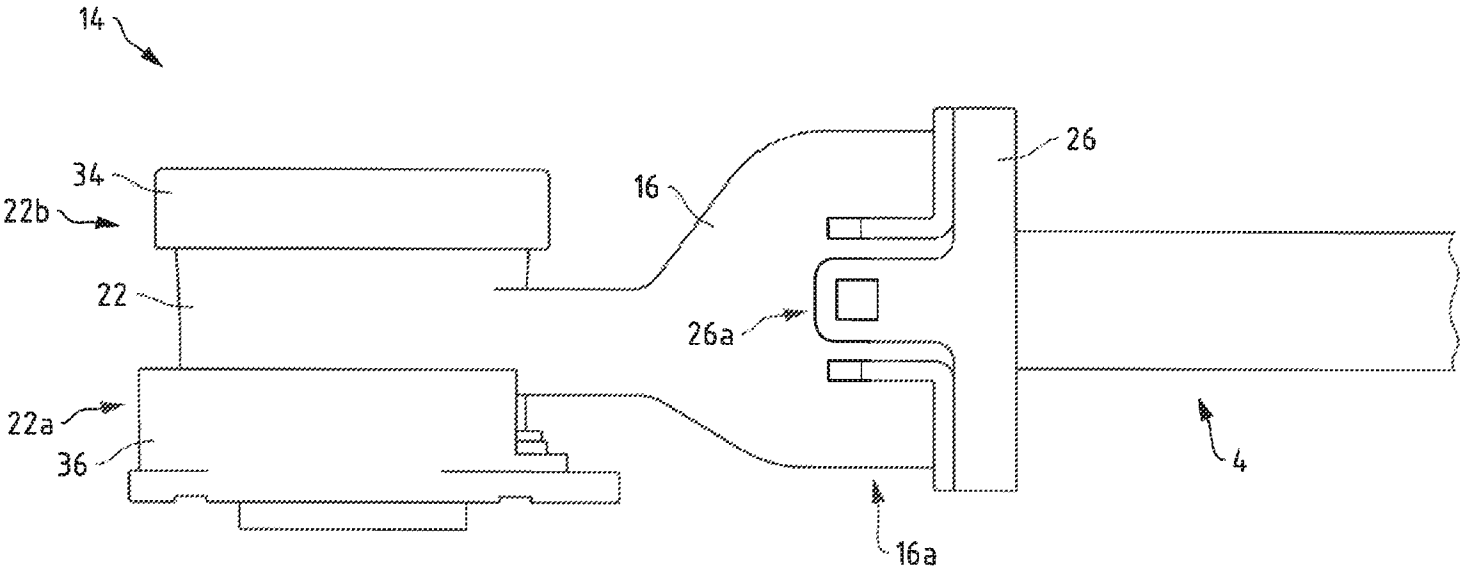
FIG. 3 another schematic view of a seal housing according to an embodiment.

FIG. 3 shows the seal housing 14 with the end cover 26 fitted onto the receiving region 16*a*. It can be seen that the end cap 26 engages with a clip fastener 26*a* relative to the seal housing 14. The clip fastener 26*a* is formed such that the end cap 26 is pressed against the receiving portion 16*a* with a force.

Further, it can be seen that a lid 34 is disposed on the cover region 22*b* of the dome 22. The cover 34 locks relative to the seal housing 14 and is pressed against the cover region 22*b* with a force. A housing receptacle 36 is provided at the bottom region 22*a*. The housing receptacle 36 is bolted to the dome 22 or the bottom region 22*a*, so that the housing receptacle 26 is pressed against the bottom region 22*a* with a force.

In this assembled state, the seal housing 14 is sealed and a connection between a contact element and the cable lug 2 within the receptacle of the dome 22 is protected from water.

Figure 4:
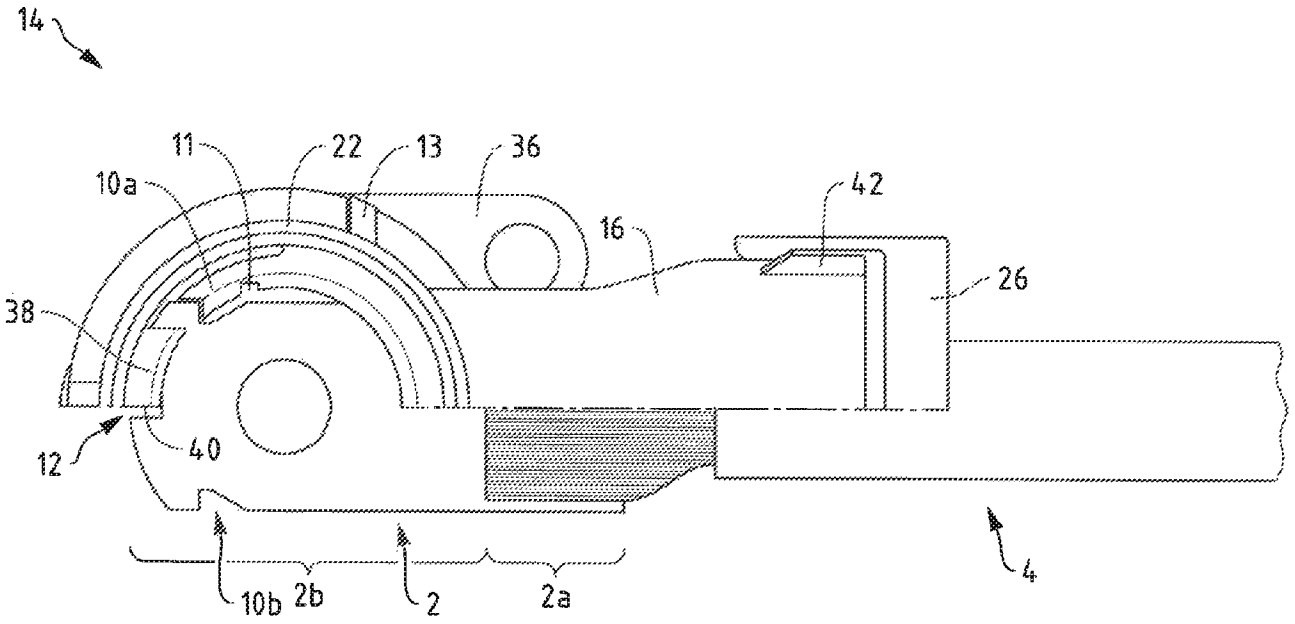
FIG. 4 a partial section through a seal housing with a cable lug according to an embodiment.

The manner in which the cable lug 2 locks into the seal housing 14 is shown schematically in FIG. 4. FIG. 4 shows a top view of a seal housing 14 with a partial longitudinal section. It can be seen that the cable lug 2 is inserted with its fastening region 2*b* into the receptacle of the dome 22. The resilient elements 10*a* on the guide rails 38 engage with recesses 10*b* of the cable lug 10.

Also to be seen is that transversely extending receptacles 11 are formed on the resilient elements 10*a*. A spreading tool can engage in the receptacles 11 to spread the resilient elements 10*a* radially outwardly. The resilient elements 10*b* thus release the recess 10*b* and the cable lug 2 can be pulled out of the housing.

To prevent the housing from twisting, radially outwardly extending webs 13 are provided which can engage a housing dome.

A portion of a guide rail 38 is shown. Within this guide rail 38, at the base of the groove, is a projection 40 which engages with the anti-rotation protection 12.

It can also be seen that the end cap 26 engages behind a projection 42 of the seal housing 14.

Figure 5:
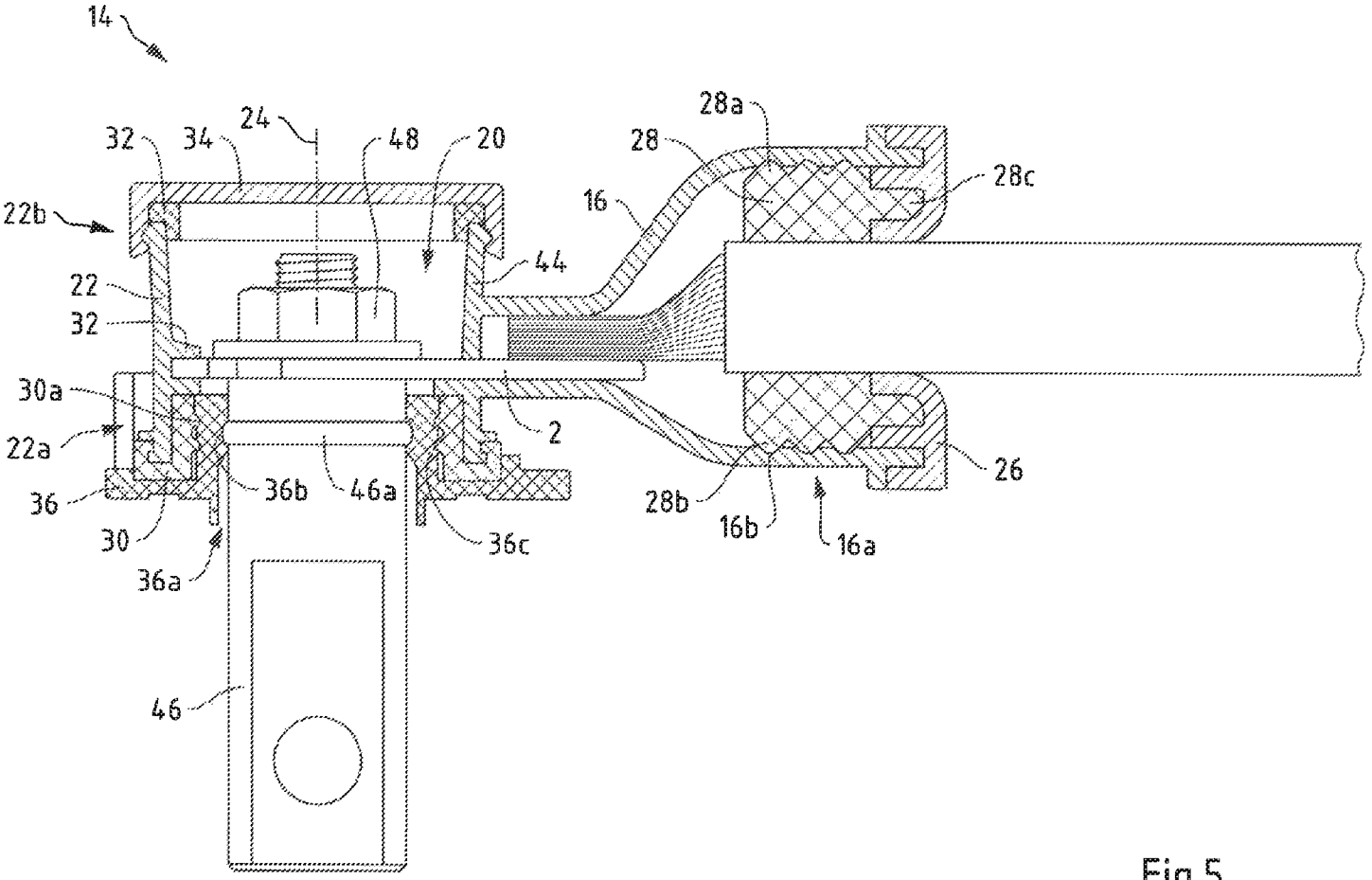
FIG. 5 a longitudinal section through a seal housing with a cable lug according to embodiments.

FIG. 5 shows a longitudinal section through a seal housing 14 with a cable lug 2. At the receiving region 16*a*, the cable 4 with the insulator 4*a* is inserted into the cable entry 16. Circumferentially surrounding the cable 4 is the seal 28.

It can be seen that the seal 28 has ribs 28*a* pointing radially outwards. The ribs 28*a* are spaced from one another in the longitudinal direction 18. The ribs 28*a* engage optional grooves 16*b* of the receiving portion 16*a* or abut the inner peripheral surface of the receiving portion 16*a*. The grooves 16*b* are arranged circumferentially on the inner peripheral surface of the receiving region 16*a* and, in particular, are complementary to the ribs 28.

Apart from the ribs 28*a*, radially inwardly facing ribs 28*b* are further arranged on the seal 28 and are also spaced apart from one another in the longitudinal direction 18. The radially inwardly facing ribs 28*b* are also preferably circumferential. The seal 28 is compressed by the inserted cable 4, the ribs 28*a* are pressed against the inner peripheral surface of the receiving region 16*a* and the ribs 28*b* are pressed against the insulator 4*b* of the cable 4.

Pointing longitudinally 18 away from the dome 22, a sealing lip 28*c* is provided on the seal 28. The sealing lip 28*c* is also preferably circumferential. The sealing lip 28*c* is received by a groove 26*a* disposed on the end cap 26. In the connected state, the groove 26*a* of the end cap 26 points into the interior of the receiving region 16*a*. Furthermore, the end cover 26 circumferentially engages around an end edge of the receiving region 16*a*.

The inserted cable lug 2 extends through a wall 44 between the cable entry 16 and the through channel 20. In the through channel 20, the cable lug 2 is engaged with its fastening region 2*b*, as shown in FIG. 4. At the bottom region 22*a*, a housing receptacle 36 is fitted onto the dome 22. The housing receptacle 36 has a through channel 36*a* for receiving a contact element 46. In the present case, the contact element 46 is a bolt. The contact element 46 can be inserted into the dome 22 in the transverse direction 24 through the through channel 36. A seal 46*a* arranged on the contact element 46, in particular a sealing ring, thereby comes into engagement with a groove 36*b* running around the inner wall of the through channel 36*a*. The seal 46*a* thus seals the through channel 36*a*. The contact element 46 can also be overmolded with the housing receptacle 36. In this case, the seal 46*a* can be omitted. In this case, the contacting surface is much closer to the contact element.

The contact element 46 is pushed through the contact opening 6 of the cable lug 2 during insertion in the transverse direction 24. On the side of the cable lug 2 opposite the bottom region 22*a*, the contact element 46 is fixed, in particular screwed, to the cable lug by a nut 48.

For sealing the bottom region 22*a*, the seal 30 runs circumferentially along a front edge of the bottom region 22*a*. In this connection, the seal 30 may be provided on the inner side of the bottom region 22*a* with ribs 30*a* spaced-apart from one another which point radially inwards. These ribs 30*a* engage with circumferential grooves 36*c* on the outer peripheral surface of the through channel 36*a*. Also, the outer peripheral surface of the passageway 36*a* may be smooth.

The housing receptacle 36 circumferentially engages the seal 30 at the end surface.

The housing receptacle 36 may include a circumferential collar facing toward the cover portion 22*b*. This collar may project beyond the seal 30 in the transverse direction 24. This protects the seal 30 from splashing water.

In the cover region 22*b*, after the nut 48 has been tightened, a lid 34 is placed on the seal housing 14. In the process, the seal 24 is pressed by the lid 34 against the end face of the dome 22. The housing 14 is thus sealed. The lid can also be screwed into place. This is shown in FIG. 7.

Figure 6:
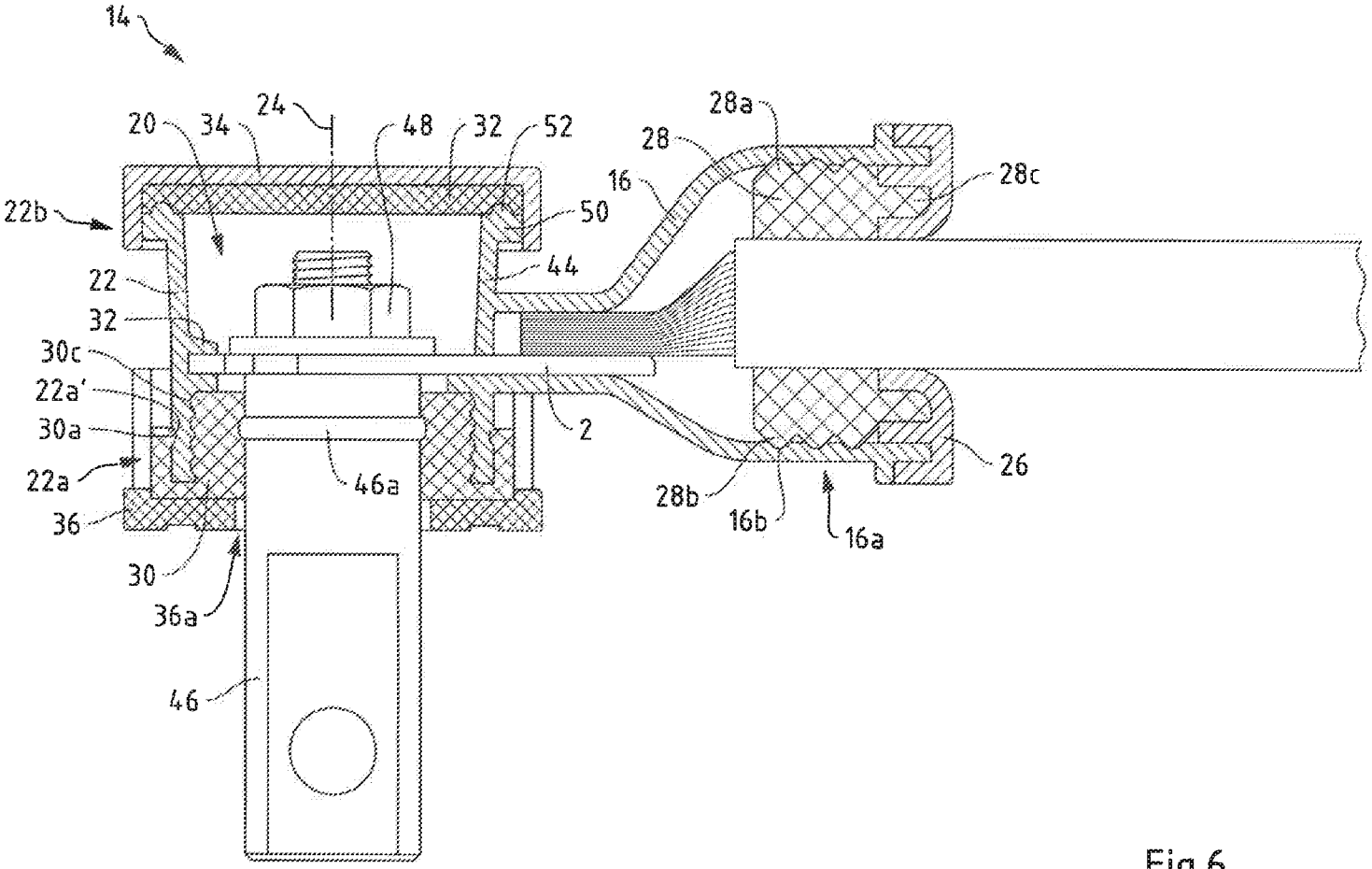
FIG. 6 a schematic view of a cable lug with seal housing according to an embodiment.

FIG. 6 schematically shows a sealing of the seal housing 14 as described in connection with FIG. 5. It can be seen that a projection 52 pointing outward in the transverse direction 24 is provided on an end face 50 of the cover region 22*b*. This protrusion 52 comes into engagement with the seal 28, thereby sealing the lid 34 with respect to the dome 22.

In FIG. 6, it can further be seen that the seal 30 has a circumferential radially inwardly facing projection 30*a* on the outer peripheral surface of the base portion 22*a*, which engages a recess 22*a'* on the outer peripheral surface of the base portion 22*a*. The housing recess 36 presses the seal 30 against the outer mantle surface of the bottom region 22*a*. Further, the seal 30 also has spaced apart ribs 30*c* in the region of the inner peripheral surface of the bottom region 22, which are pressed against the inner peripheral surface of the bottom region 22.

Figure 7:
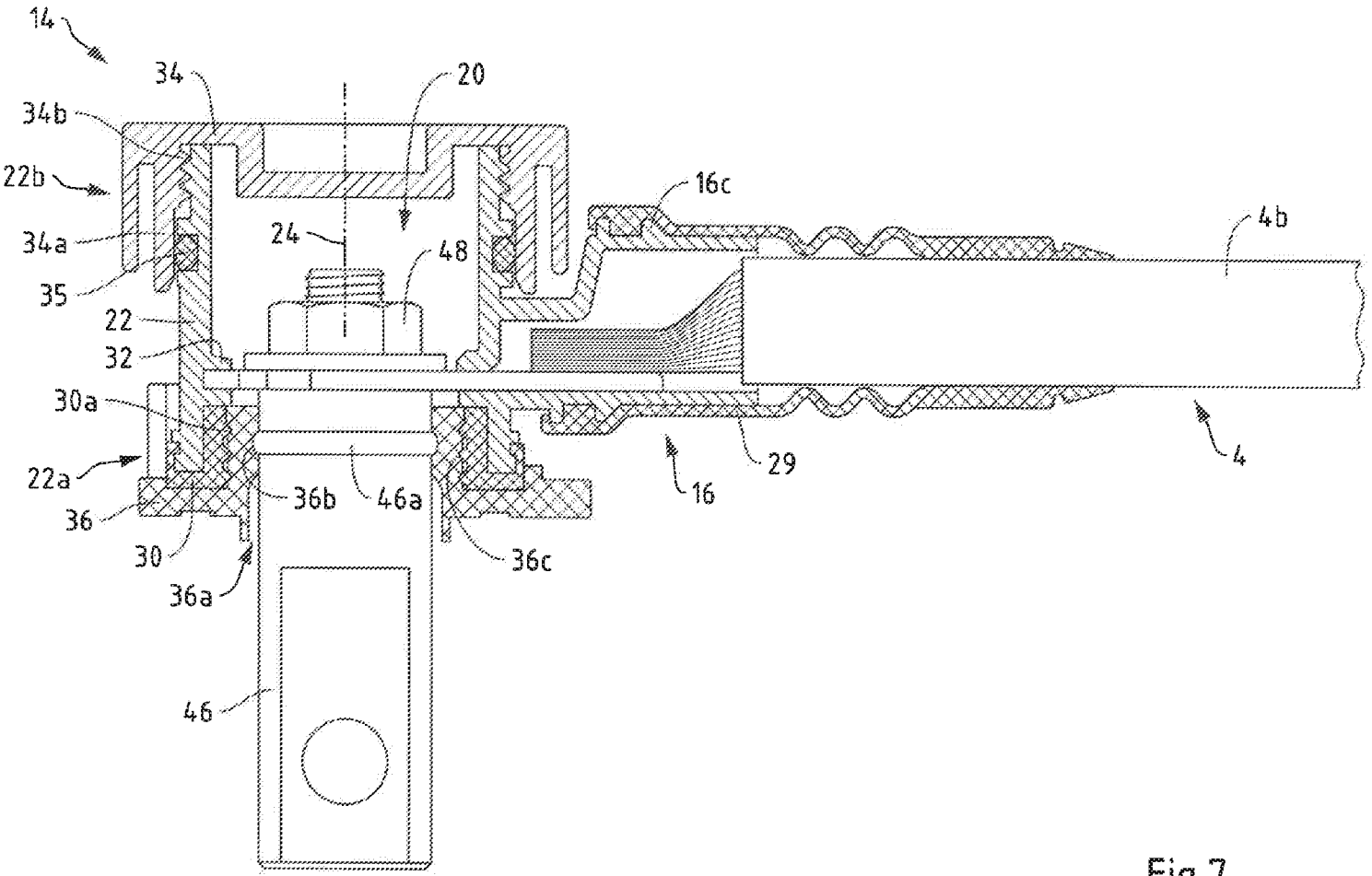
FIG. 7 a schematic view of a cable lug with seal housing according to an embodiment.

FIG. 7 shows another alternative of a seal housing 14. It can be seen that the lid 34 is formed as a screw lid. The lid 34 has a circumferential lid edge 34*a*. The lid rim 34*a* extends in the transverse direction 24 beyond the thread 34*b*. A sealing ring 35 is provided between the lid edge 34*a* and the cover region 22*b*.

In the area of the cable entry 16, a grommet 29 lies around the outer peripheral surface of the cable entry 16. The grommet 29 engages with a circumferential groove 16*c* on the outer peripheral surface of the cable entry 16. The grommet 29 may be formed as a bellows. The grommet 29 rests against the insulator 4*b* of the cable 4.

In the bottom region 22*a*, the seal 30 circumferentially engages the front edge of the seal housing 14 according to FIG. 6. Unlike in FIG. 6, the seal 30 does not rest against the contact element 46. Rather, the contact element 46 is guided in a sealed manner in the housing receptacle 36. The seal 30 is in circumferential contact with the outer peripheral surface of the housing receptacle 36. The housing receptacle 36 has an outer collar 36*b* that preferably circumferentially engages around the seal 30.

By means of the arrangement shown, it is possible to protect a cable connection between a cable lug and a contact element against moisture.

LIST OF REFERENCE SIGNS

2 Cable lug
2' Connection region
2*b* Fastening region
4 Cable
4*a* Stranded wire
4*b* Insulator
6 Contact opening
8 Outer edge
8' Front edge
10 Latching means
12 Anti-twist protection
14 Seal housing
16 Cable entry
18 Longitudinal direction
20 Through channel
22 Dome
22*a* Bottom region
22*a'* Recess
22*b* Cover region
24 Transverse direction
26 End cap
26*a* Clip closure
28 Gasket
28*a,b* Ribs
29 Grommet
30, 32 Gasket
34 Lid
34*a* Lid rim 34*b* Thread 36*b* Collar 36 Housing receptacle 36*a* Through channel 36*b* Groove 38 Guide groove 40 Protrusion 42 Protrusion 44 Wall 46 Contact element 46*a* Gasket 48 Nut 50 end face 52 Projection

What is claimed is:

1. Seal housing for a cable lug comprising:
a cable entry extending in a longitudinal direction,; and
a dome extending in a transverse direction, transversely to the longitudinal direction, wherein
the cable entry extends in the longitudinal direction towards the dome and terminates in the dome,
the dome has a cable lug receptacle for the cable lug, and
the dome has a through channel extending in a transverse direction, which extends in the transverse direction, on both sides of the cable lug receptacle into a bottom region and a cover region, wherein
the receptacle has latching means for mechanically receiving the cable lug
wherein
the latching means has an expanding receptacle extending in the transverse direction for an expanding tool exerting a radially outwards directed expanding force onto the latching means, wherein the latching means are pivotable transversely to the longitudinal direction and
there is a free space in the cable lug receptacle for receiving the radially outwardly bent latching means when spread.

2. Seal housing according to claim 1, wherein the latching means are formed for positive latching with the cable lug in the longitudinal direction.

3. Seal housing according to claim 1, wherein the latching means are transversely pivotable in a resilient manner.

4. Seal housing according to claim 1, wherein the cable lug receptacle has an anti-twist protection which is arranged in the longitudinal direction opposite of the cable entry.

5. Seal housing according to claim 4, wherein the anti-twist protection has a projection extending in the longitudinal direction in the direction of the cable entry, the projection engaging in a detent groove of the cable lug.

6. Seal housing according to claim 4, wherein the anti-rotation device has a groove for receiving an end edge of a fastening region of the cable lug.

7. Seal housing according to claim 1, wherein the through channel is aligned with the cable lug receptacle such that a center axis of the dome passes through a center of a contact opening of a cable lug latched in the cable lug receptacle.

8. Seal housing according to claim 1, further comprising a circumferential sealing ring extending in the transverse direction and arranged in the cover region.

9. Seal housing according to claim 1, further comprising a flange extending radially outwards and arranged in the cover region on an end edge.

10. Seal housing according to claim 1, wherein the cover region is formed to receive a lid, the lid being positively fastened in the fastened state to the cover region in the transverse direction and/or a seal is arranged between an inner side of the lid and an end face of the cover region and/or between a lid wall and an outer peripheral surface of the cover region.

11. Seal housing according to claim 1, wherein the cable entry is separated from the through channel of the dome by a wall, the wall having an opening for the cable lug.

12. Seal housing according to claim 1, wherein the cable entry has a receiving region for a cable attached to the cable lug.

13. Seal housing according to claim 12, wherein a circumferential sealing ring is arranged on the inner wall of the seal housing in the receiving region.

14. Seal housing according to claim 13, wherein a grommet is arranged on the outer peripheral surface of the receiving region.

15. Seal housing according to claim 13, wherein the sealing ring has ribs spaced apart in the longitudinal direction, facing radially outwards and/or the sealing ring has ribs spaced apart in the longitudinal direction, facing radially inwards.

16. Seal housing according to claim 13, wherein the sealing ring has a sealing lip extending in the longitudinal direction on its end face facing away from the dome.

17. Seal housing according to claim 12, wherein an end cap is arranged on the receiving region, wherein the end cap embraces the receiving region on an outer peripheral surface.

18. Seal housing according to claim 17, wherein the end cap has a receptacle for a cable.

19. Seal housing according to claim 17, wherein the end cap has groove webs within the cable entry pointing in the longitudinal direction in the direction of the dome which span a groove into which the sealing lip is received.

20. Seal housing according claim 17, wherein the end cap latches with latching means on an outer peripheral surface of the receiving region.

21. Seal housing according to claim 1, wherein the bottom region is formed to receive a housing receptacle.

22. Seal housing according to claim 21, wherein the housing receptacle is part of a housing dome of an electrical add-on part.

23. Seal housing according to claim 1, wherein the housing receptacle comprises a through channel for receiving a contact element.

24. Seal housing according to claim 23, wherein a seal is arranged between the contact element and the inner wall of the through channel.

25. Seal housing according to claim 23, wherein the through channel extends in transverse direction into the dome.

26. Seal housing according to claim 1, wherein a seal is arranged on an end face of the bottom region, in particular a seal arranged on an end face of the bottom region engages around the end edges of the bottom region on both sides.

27. Seal housing according to claim 26, wherein the seal is arranged on the end face of the bottom region between the seal housing and the housing receptacle.

28. Seal housing according to claim 26, wherein the seal has ribs being spaced in transverse direction, facing radially inwards on the end face of the bottom region.

29. System including a seal housing according to claim 1 and further comprising:

a cable lug with a connection region for an electrical cable and a fastening region for fastening in a receptacle of the seal housing, wherein the fastening region is formed as a flat part and at least one latching means is formed on its outer edge, as well as an expanding tool for engaging with the expanding receptacle and for exerting a radially outwardly directed expanding force onto the latching means.

* * * * *